US009017231B2

(12) United States Patent
Kosich

(10) Patent No.: US 9,017,231 B2
(45) Date of Patent: Apr. 28, 2015

(54) LOWER BODY MUSCLE EXERCISE DEVICE

(76) Inventor: Mark M Kosich, Bailey, NC (US)

( * ) Notice: Subject to any disclaimer, the term of this patent is extended or adjusted under 35 U.S.C. 154(b) by 441 days.

(21) Appl. No.: 13/407,469

(22) Filed: Feb. 28, 2012

(65) Prior Publication Data

US 2012/0225757 A1 Sep. 6, 2012

Related U.S. Application Data

(60) Provisional application No. 61/464,202, filed on Mar. 1, 2011.

(51) Int. Cl.

| | |
|---|---|
| ***A63B 23/04*** | (2006.01) |
| ***A63B 21/065*** | (2006.01) |
| ***A63B 21/075*** | (2006.01) |
| ***A63B 21/00*** | (2006.01) |

(52) U.S. Cl.

CPC ..... *A63B 23/04* (2013.01); *A63B 21/065* (2013.01); *A63B 21/075* (2013.01); *A63B 21/143* (2013.01); *A63B 21/1465* (2013.01)

(58) Field of Classification Search

CPC ..... A63B 21/065; A63B 21/072; A63B 21/0724; A63B 21/0726; A63B 21/0123; A63B 21/1426; A63B 21/143; A63B 23/04; A63B 21/075; A63B 21/1465

USPC ..... 482/79–80, 132, 105–109

See application file for complete search history.

(56) References Cited

U.S. PATENT DOCUMENTS

| | | | | |
|---|---|---|---|---|
| 4,964,631 | A * | 10/1990 | Marano | 482/93 |
| 6,196,950 | B1 | 3/2001 | Emick | |
| 6,206,807 | B1 * | 3/2001 | Cowans et al. | 482/79 |
| 6,592,497 | B2 * | 7/2003 | Greenheck | 482/93 |
| 7,081,072 | B2 * | 7/2006 | Allen | 482/106 |
| 7,731,639 | B1 * | 6/2010 | Shifferaw | 482/92 |

* cited by examiner

*Primary Examiner* — Loan H Thanh
*Assistant Examiner* — Jennifer M Deichl

(57) ABSTRACT

An exercise device comprises a plurality of parallel structures having adequate length or height to insert the active foot of an operator and further comprises foot support means interconnecting the plurality of parallel structures, means to secure weights, and means to add or subtract weights. The device may be constructed of rigid or flexible materials or a combination of rigid and flexible materials. The device may also comprise means to minimize swinging motion. An operator, having an active leg and foot, inserts an active foot within the space between parallel structures, engages the foot support means with an active foot to perform lower body muscle exercises, for example, the quadruped hip extension exercise for the benefit of the gluteus muscle group, leg extensions for the benefit of the vastus medialis muscle or leg contractions for the benefit of the posterior thigh muscle group.

7 Claims, 11 Drawing Sheets

LOWER BODY MUSCLE EXERCISE DEVICE

CROSS REFERENCE TO RELATED APPLICATIONS

U.S. Application No. 61/464,202; Filing Date: Mar. 1, 2011

STATEMENT REGARDING FEDERALLY SPONSORED RESEARCH OF DEVELOPMENT

Not Applicable

DESCRIPTION OF ATTACHED APPENDIX

PTO/SB/08a (01-10) Information Disclosure Statement

BACKGROUND OF THE INVENTION

This invention relates generally to the field of exercise equipment for weight resistance training for the primary benefit of the lower body muscles, for example, the quadruped hip extension exercise for the benefit of the gluteus muscle group, leg extensions for the benefit of the vastus medialis muscle and leg contractions or leg curls for the benefit of the posterior thigh muscle group (hamstring muscles) including, for example, biceps femoris, semitendinosus, and semimembranosus muscles. The invention relates more specifically to a non-mechanical device for weight resistance training that can hold substantial weight in a balanced manner, is free of the requirement to attach the device to the foot or ankle and allow an operator ease of access and comfortable positioning to perform lower body muscle exercise.

To strengthen and develop the lower body muscles there are a number of categories of exercise: calisthenics exercise, weight resistance exercise with free weights and weight resistance exercise with machines.

The first and simplest approach is to engage in calisthenics type training using body positioning and body motion with gravity to create tension or resistance on a particular muscle or muscle group and thereby achieve a degree of muscle tone. While a reasonable degree of muscle tone can result, increase in muscle strength and growth may be limited. Since the lower body has the largest muscle groups of the body, it is difficult to develop the muscles beyond the toning stage and obtaining substantial muscle strength and development is limited unless adequate resistance can be achieved.

Ankle weights are known for use in weight resistance lower body muscle exercises including the quadruped hip extension exercise for the benefit of the gluteus muscle group, leg extensions for the benefit of the vastus medialis muscle and leg contractions or leg curls for the benefit of the posterior thigh muscle group (hamstring muscles) including, for example, biceps femoris, semitendinosus, and semimembranosus muscles.

Ankle weights hold generally from about two pounds/one kilogram to about twenty pounds/ten kilograms. If they are to hold more weight that this, the ankle weight becomes very difficult to hold in place on the ankle and lower leg area. In the case of performing the quadruped hip extension exercise, an operator must start in a sitting position to attach the ankle weight to the ankle and then move to the quadruped position (on hands and knees). The lower leg is now in a horizontal position. To begin the exercise, the lower leg must then be inclined. The foot is raised to an elevated position with the lower leg inclined to about sixty to ninety degrees vertical. If the ankle weight has too much weight, lifting the foot upward becomes difficult and cumbersome for the operator. In addition, when the exercise is complete, the foot has to be lowered to the floor again. It is likely that an exhausted operator will allow the foot with weighted ankle to fall to the floor too suddenly. The operator then has to reposition himself to a sitting position to remove the ankle weight. With ankle weights, a degree of effectiveness is lost since the weight is attached to the lower leg area. More weight resistance would be achieved if the weight could be attached further downward, at the foot for example.

A boot or shoe device intended as an alternative to ankle weights is also known. This type device is of rigid design, likely steel or aluminum construction that attaches to the foot and ankle of the user. The device utilizes weight plates that attach to sole of the shoe or to the back of the device behind the heel of the foot of the user. When connected to the foot and ankle of the user, the device functions in a way that is very similar to ankle weights when used for performing lower body muscle exercises such as quadruped hip extension, leg extension and leg contraction or leg curl. It is unlikely that the device can hold more weight than ankle weights. Further, if the weight is concentrated behind the posterior side of the calcaneus area of the heel and the Achilles tendon area of the ankle, the center of gravity is offset from the center of the lower leg and foot. Therefore, an unbalanced condition is likely to be felt by the user resulting in less than ideal control of the device when moving through a range of motion to perform an exercise. When used for lower body muscle training, for example, the quadruped hip extension exercise, disadvantages of the prior art are similar to the disadvantages of ankle weights. Further, the prior art is restricted to the use of a dedicated type of weight which ads cost to the device. Materials and fabrication also contribute to high cost of such a device.

Free weights exercises using dumbbells or barbells with plate weights can include squats, lunges, leg press and dead lifts. These exercises benefit gluteus muscle development to some extent but they are most effective as quadriceps building exercises. These weight lifting exercises can place stress on the spine and knees. People having back problems should avoid squat exercises that load the spine. Lunges, step-ups and squats can place strain on knee joints. Performing squats, lunges, leg press and dead lifts with substantial weight can place stress on the skeleton, muscles, tendons and ligaments which can lead to discomfort and damage to these structures.

Another approach to training for the primary benefit of the lower body muscles involves weight resistance exercise with machines. A machine can offer mechanical advantage by providing a concentrated focus on a particular muscle group or just one individual muscle. As the muscle group strengthens, more weight can be added and further muscle strength and development can be achieved. More elaborate equipment can have levers and pulleys and sophisticated means for adding and subtracting weight.

An example of a commonly used type of machine for working out the gluteus muscle group is the gluteus isolator exercise machine. Further, there is the leg extension machine for the benefit of the vastus medialis muscle and leg contraction or leg curl machine for the benefit of the posterior thigh muscle group (hamstring muscles) including, for example, biceps femoris, semitendinosus, and semimembranosus muscles.

Exercise machines usually have a specific design for movement along an engineered path. It is difficult to design a machine that can move in a way that can accommodate all body types. Therefore, a set range of motion can cause stress and discomfort if the skeleton, muscles, tendons and ligaments are forced to move in a manner that is less than ideal. Other disadvantages of machines include complexity, forced range of motion, space requirement and high cost.

There is a need for a non-mechanical device that has the advantage of simplicity, space savings and low cost of calisthenics exercise yet also provides the advantage of mechanical equipment such as the ability use weights and to increase resistance as needed to further the strengthening and development of the lower body muscle groups, and further, to provide balance by way of alignment of the center of gravity of the weight in harmony with the body of the user. In addition, there is a need for a device that provides advantage in strengthening and developing lower body muscle groups while minimizing discomfort and stress to the skeletal structure, muscles, tendons and ligaments. There is a need for a device that is highly mobile that can be moved easily, stored out of the way or out of sight. There is a need for a device that can be used in the home, office, school dormitory, apartment or condominium. There is a need for a device that allows for range of motion that suits the individual user. And further, there is a need for a device that can hold substantially more weight in a balanced manner than the present art while allowing an operator to get into a reasonable position to perform lower body muscle exercises. And further still, there is a need for a device that utilizes readily available weights, for example, dumbbells.

Advantages that address the above concerns can be achieved with the invention as described in later sections of this document.

BRIEF SUMMARY OF THE INVENTION

The primary advantage of the invention is an exercise device to perform lower body muscle exercises, for example the quadruped hip extension exercise for the benefit of the gluteus muscle group, leg extensions for the benefit of the vastus medialis muscle or leg contractions for the benefit of the posterior thigh muscle group (hamstring muscles) including, for example, biceps femoris, semitendinosus, and semimembranosus muscles.

Another advantage of the invention is a non-mechanical device that provides simplicity, space savings and low cost yet has the advantage of mechanical equipment such as the ability to use weights and increase weight as needed to for strengthening and development of the lower body muscle groups.

A further advantage of the invention is a device that can hold substantial weight while allowing an operator to easily get into proper position to perform lower body muscle exercises.

And yet another advantage of the invention is a device that is utilized in strengthening and developing lower body muscle groups while minimizing discomfort and stress to the skeletal structure, muscles, tendons and ligaments of the body often associated with weight lifting using free weights and weight lifting machines.

Another advantage of the invention is to provide balance of the device with the center of gravity of secured weights in harmony with the anatomy of the body of the user.

Another advantage of the invention is the capability to adjust length or height of key components to accommodate variation of body types of users.

A further advantage of the invention is to provide foot support means at an elevated position so that an operator with an active foot in an elevated starting position, more easily performs the quadruped hip extension exercise for the benefit of the gluteus muscle group.

Another advantage of the invention is to provide anterior leg stabilizer means, to engage at least a portion of the anterior area of the active lower leg or knee or both lower leg and knee area and engage the appropriate body surfaces in consideration of the anatomical construction of the lower leg and ankle area of the operator thereby providing stability by minimizing swinging motion.

And yet another advantage of the invention is to offset the anterior leg stabilizer to compensate for the desired angle of an active lower leg, wherein an operator may incline the active lower leg from a vertical ninety degree orientation to an angle of lesser degree, while performing the quadruped hip extension exercise.

Another advantage of the invention is to provide posterior leg stabilizer means, to engage at least a portion of the posterior area of the active lower leg or ankle or both lower leg and ankle area and engage the appropriate body surfaces in consideration of the anatomical construction of the lower leg and ankle area of the operator thereby providing stability by minimizing swinging motion.

A further advantage of the invention is to offset the posterior leg stabilizer to compensate for the desired angle of an active lower leg, wherein an operator may incline the active lower leg from a vertical ninety degree orientation to an angle of lesser degree, while performing the quadruped hip extension exercise Another advantage of the invention is to secure dumbbells or elongated weights in a horizontal or vertical orientation.

A further advantage of the invention is to provide sufficient base area to support the lower head of a vertically oriented dumbbell or elongated weight yet comprises less area than would otherwise be needed to secure weights in the horizontal orientation, thereby minimizing incidental contact of the device with a passive leg or foot.

Another advantage of the invention allows an operator to engage a foot support means with the dorsal (upper) surface of an active foot or the anterior ankle area, or a combination of both dorsal foot and anterior ankle surface, to perform the leg extension exercise for the benefit of the vastus medialis muscle.

Another advantage of the invention allows an operator to engage a foot support means with the posterior side of the calcaneus area of the heel or the Achilles tendon area of the ankle or a combination of both calcaneus area and Achilles tendon area, to perform the leg contraction (leg curl) exercise for the benefit of the posterior thigh muscle group (hamstring muscles) including, for example, biceps femoris, semitendinosus, and semimembranosus muscles.

And yet another advantage of the invention is to provide plantar foot stabilizer means, to engage at least a portion of the plantar (underside) surface of the active foot, thereby providing stability by minimizing swinging motion.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

A detailed description of the invention is provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
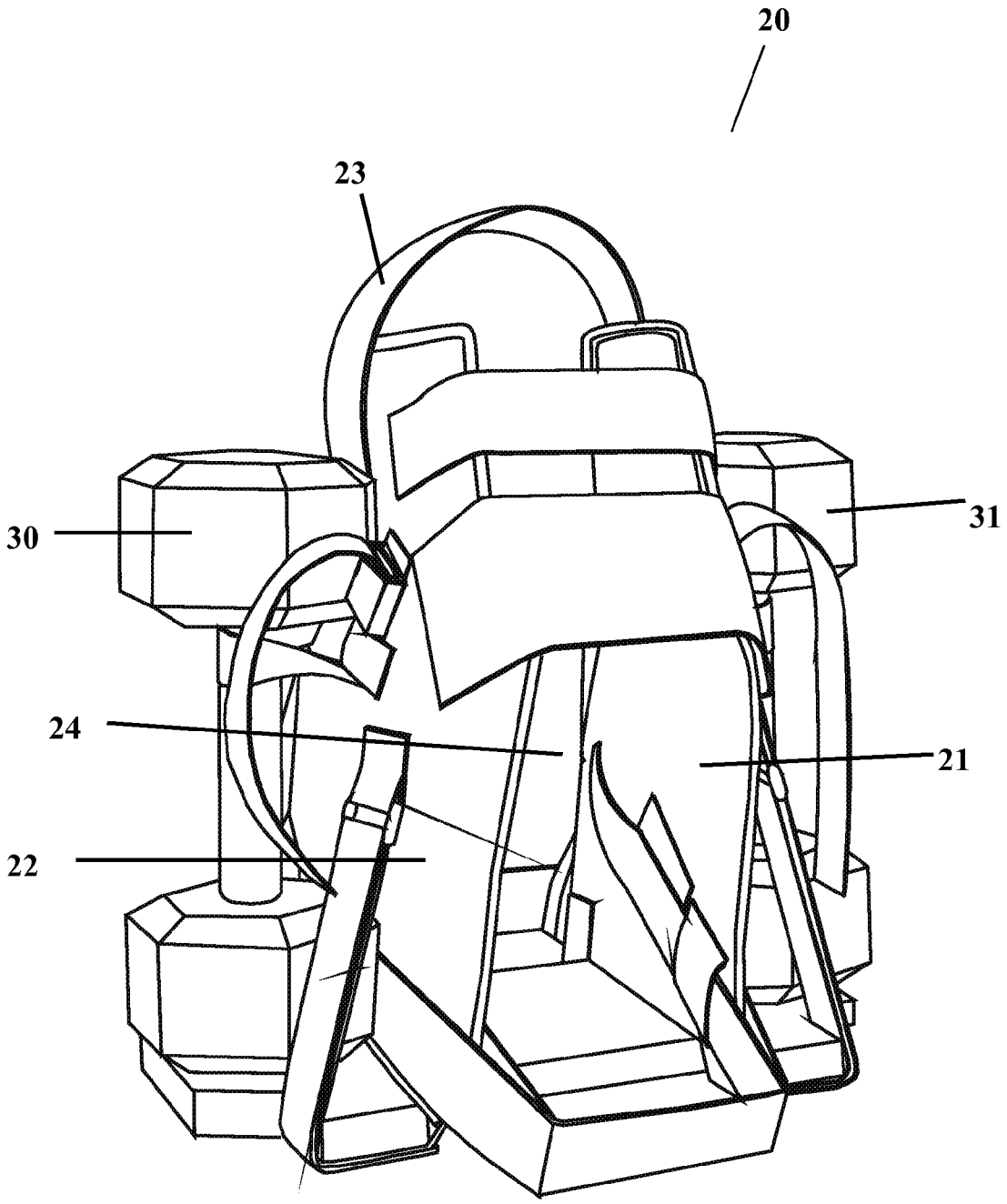
FIG. 1 is a perspective front view of the invention.

Turning first to FIG. 1, a front perspective view of the invention 20 shows the invention 20 which may be constructed of any of a wide range of materials including rigid material, flexible material or a combination of rigid and flexible materials. A plurality of parallel structures 21 and 22 are arranged in a vertical orientation to hold foot support 23 in an elevated position. Foot support 23 interconnects with vertical structures 21 and 22 and spans the gap 24 between them. Parallel structures 21 and 22 are positioned with adequate space 24 between to insert the active foot of an operator and at a height or length to accommodate the active lower leg and foot of an operator. Device 20 supports horizontally or vertically oriented weight of dumbbell or dumbbell like construction shown as vertically oriented dumbbells 30 and 31.

Figure 2:
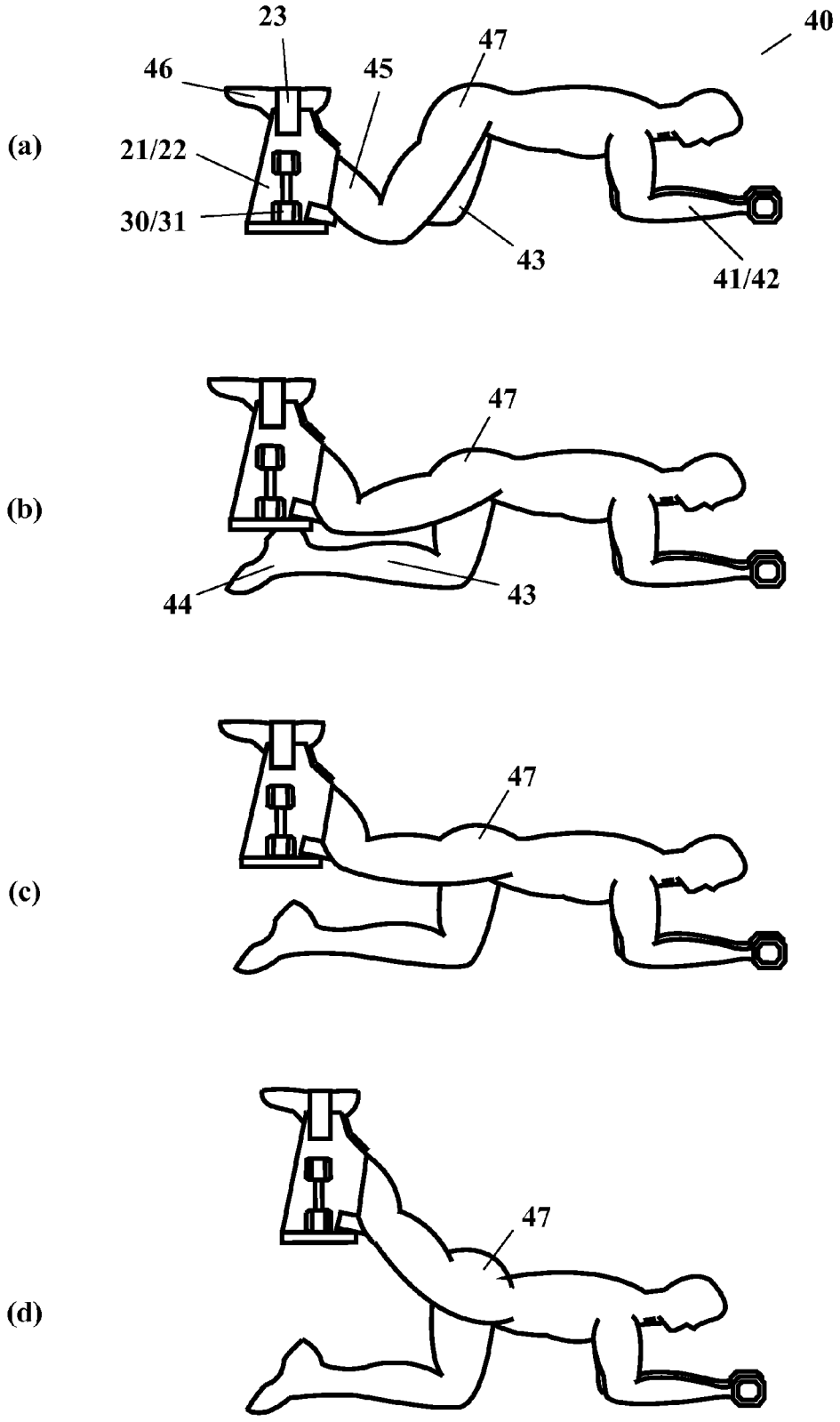
FIG. 2 is a side view sequential animation of a preferred use of the invention.

FIG. 2 provides a sequential animation showing the quadruped hip extension exercise. Segment a) has an operator 40 in a kneeling position with hands or forearms 41 and 42 resting on the floor (quadruped position), with a passive leg 43 and foot 44 positioned adjacent to device 20. Operator 40 inserts an active foot 46 between parallel structures 21 and 22, engages the underside of an active foot 46 to contact foot support 23. Operator 40 in segments a), b), c) and d) exerts a controlled backwards kick motion to lift device 20 generally vertically by raising active leg 45 to employ gluteus muscle group 47. The upward motion is continued until the gluteus muscles 47 are fully contracted as shown in segment d). To complete the exercise, sequence a through d can be reversed. Operator 40 lowers active foot 46 and active leg 45. Weights 30/31 can be added to device 20 and removed as desired. As an operator develops muscle strength, heavier weights can be used to further enhance gluteus muscle 47 strength and development.

An advantage of the invention 20 is that foot support 23 is in an elevated position so that operator 40 can engage foot support 23 with an active foot 46 in an elevated starting position to begin the quadruped hip extension exercise as shown in FIG. 2(*a*).

Figure 3:
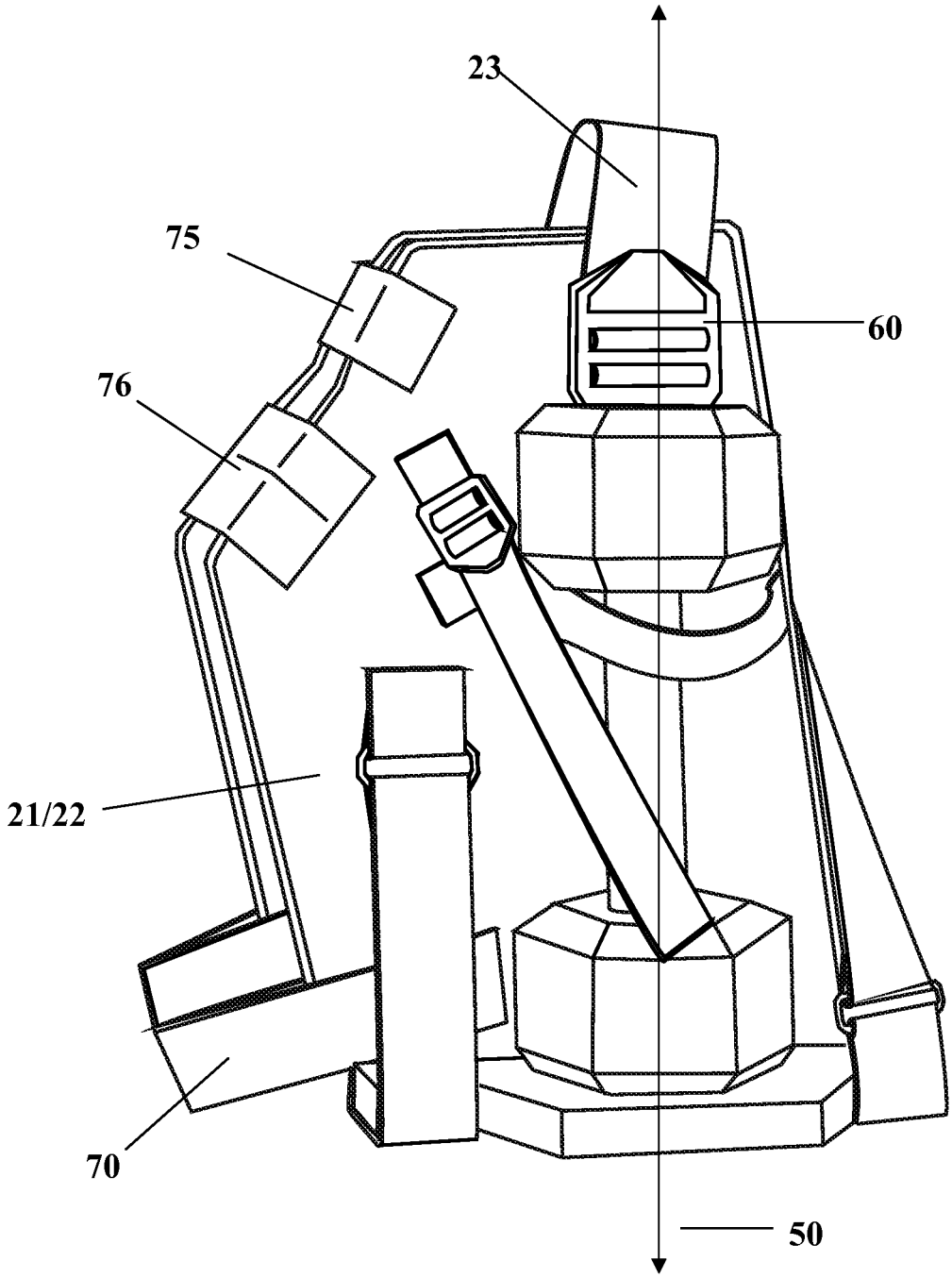
FIG. 3 is a side view of the invention.

In side view FIG. 3, foot support 23 is positioned over center of gravity shown as line 80 with double arrows. Weights 30/31 essentially determine center of gravity 80 and therefore are positioned in line with foot support 23. Foot support 23 can be adjustable for longer legs or shorter legs of different operators. Buckle 60 provides an example of a means to provide length adjustment if foot support 23 is made of fabric webbing material.

Further, in FIG. 3 we demonstrate means for stabilizing the invention throughout the range of motion of an exercise to minimize swinging of the device and to minimize the pendulum effect of the parallel structures. Anterior leg stabilizer 70 engages at least a portion of the anterior area of the active lower leg 50 or knee 47 area (shown later in FIG. 4) or both lower leg 50 and knee 47 areas. Anterior leg stabilizer 70 can be positioned on the lower section of parallel structures 21/22 to engage the appropriate body surfaces. Anterior leg stabilizer 70 can be fixed or adjustable to accommodate the comfort of the user. Hook and loop, often referred to as trademarked Velcro™ brand fabric, provides a simple adjustable means to attach and adjust the stabilizer.

Posterior leg stabilizer 75/76 engages at least a portion of the posterior area of the active lower leg 49 or ankle 48 (shown later in FIG. 4) or both lower leg 49 and ankle 48 area. Posterior leg stabilizer 75/76 can be positioned on the upper section of parallel structures 21/22 to engage the appropriate body surfaces. Posterior leg stabilizer 75/76 can be fixed or adjustable to accommodate the comfort of the user. Hook and loop, often referred to as trademarked Velcro™ brand fabric, provides a simple adjustable means to attach and adjust the stabilizer.

Figure 4:
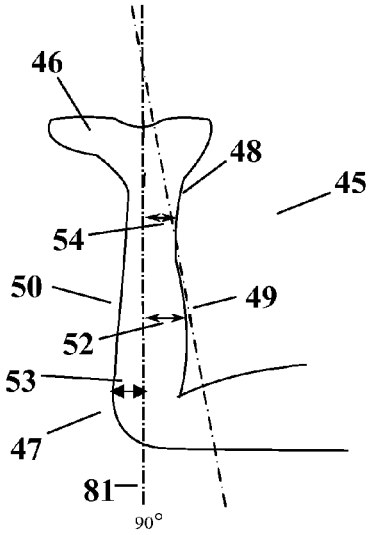
FIG. 4 is a side view of the anatomy of an operator and the relation of the anatomy to a preferred embodiment of the invention.
Figure 5:
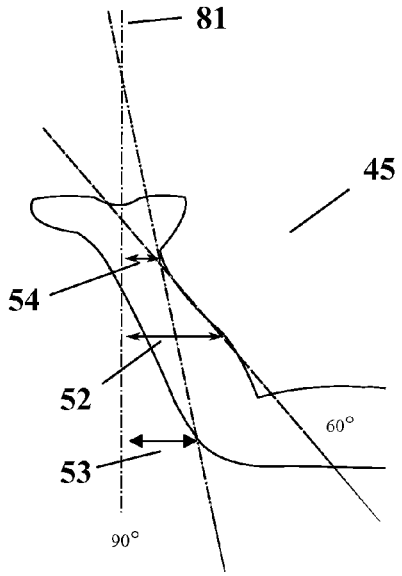
FIG. 5 is a side view further illustrating the anatomy of an operator and the relation of the anatomy to a preferred embodiment of the invention.
Figure 6:
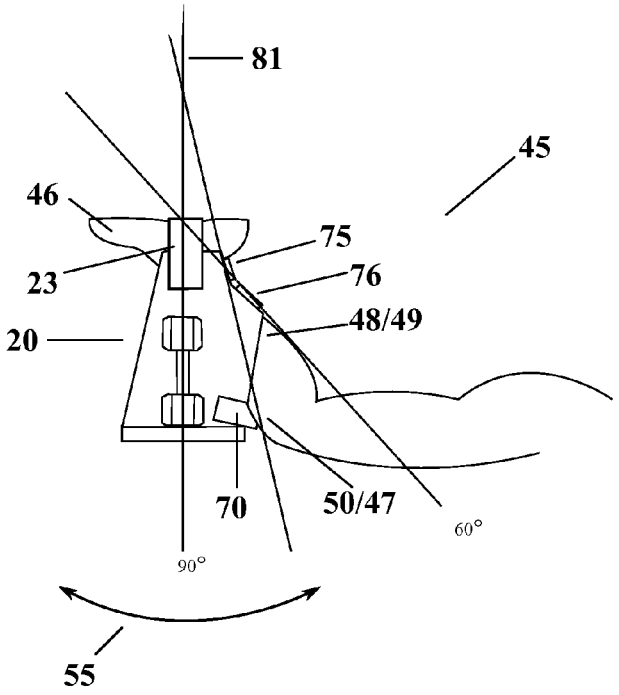
FIG. 6 is a side view further illustrating the anatomy of an operator and the relation of the anatomy to a preferred embodiment of the invention.

FIGS. 4 through 6 provide reference for discussion of the position of anterior and posterior leg stabilizers on the invention considering the anatomical construction of the lower leg and ankle area of the operator.

As illustrated in FIG. 4, lower leg 45 and foot 46 aligned vertically, as viewed from the side, has a vertical center line 81 from the arch of the foot through the ankle and lower leg. A horizontal distance 53 can be measured from center line 81 to the anterior surface of an area of the lower leg 50 and knee area 47 of the active lower leg 45. In addition, a horizontal distance 52 can be measured from center line 81 to the posterior surface of an area of the lower leg 49 of the active lower leg 45. Also, a horizontal distance 54 can be measured from center line 81 to the posterior surface of the ankle 48.

Continuing to FIG. 5, when performing the quadruped hip extension exercise, an operator will typically incline the lower active leg 45 away from the body. Distances 52, 53 and 54 will increase in length. Therefore, the position of anterior stabilizer 70 and posterior leg stabilizer 75/76 can be offset from center by an appropriate distance to engage the appropriate body surfaces of the operator and to take into consideration the angle of the active lower leg 45.

FIG. 6 shows active lower leg 45 with the invention 20 with the operator's active foot engaged with foot support 23 and active leg 45 inclined. Posterior leg stabilizer 75/76 is offset from center line 81 at two places, first at position 75 to engage posterior ankle area 48 and at a second position 76 to engage posterior lower leg area 49.

Anterior leg stabilizer 70 is offset from center line 81 to engage anterior leg area 50 and knee area 47.

Together, anterior leg stabilizer 70 and posterior leg stabilizer 75/76 provide stability through the range of motion as the operator performs the quadruped hip extension exercise and therefore minimizes swinging action that would otherwise take place as indicated by curved arrow 55.

Figure 7:
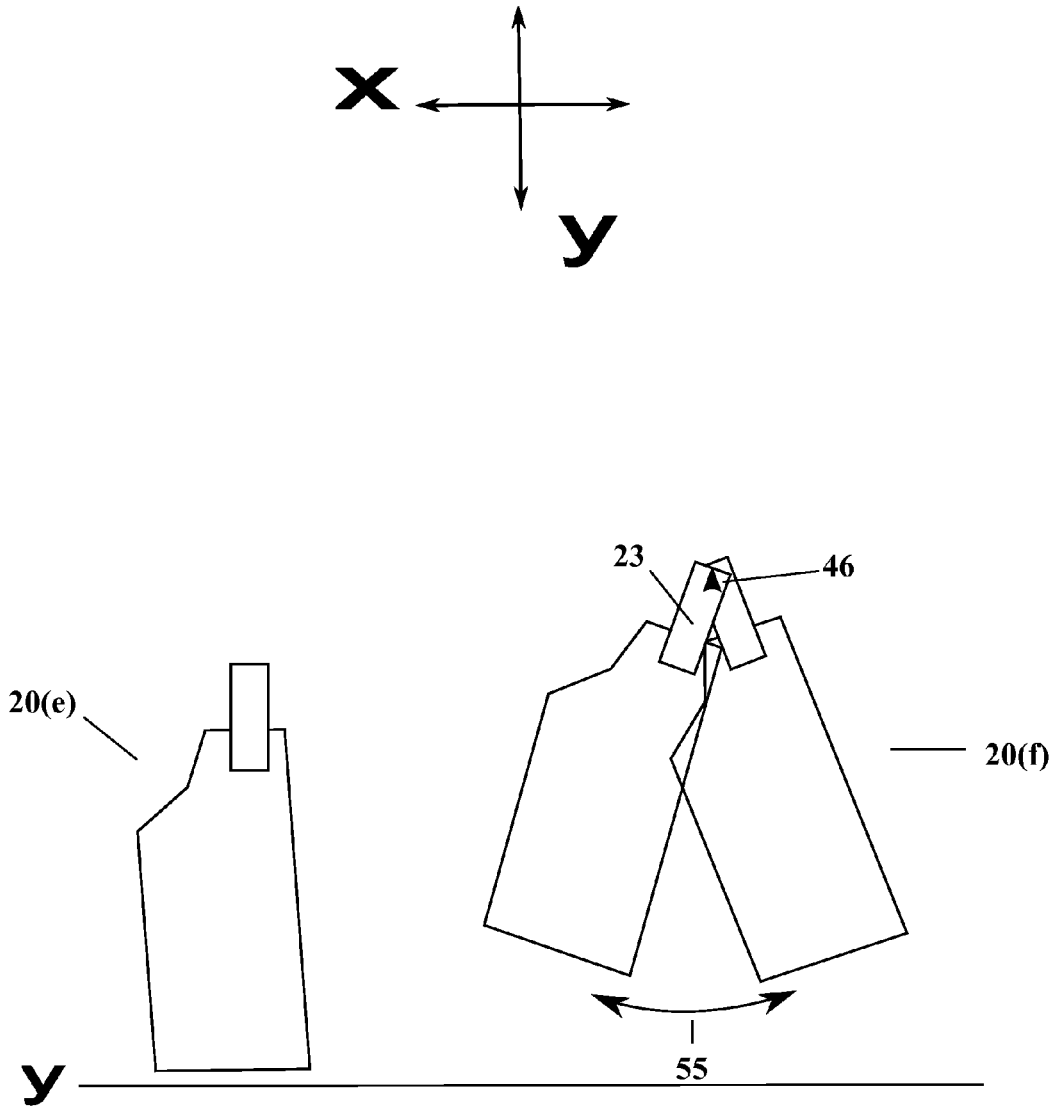
FIG. 7 is a side view of the invention depicting motion and gravity forces upon the invention when in use.

This swinging motion is depicted in FIG. 7 with a side view of invention 20(*e*) at rest and also in a lifted position 20(*f*) with active foot 46 acting as a pivot point against foot support 23. Without stabilizers, the invention is free to swing or pendulum along a "y" axis as indicated by curved arrow 55. In plan view, "y" axis is a line that runs the length of an operator's body.

Figure 8:
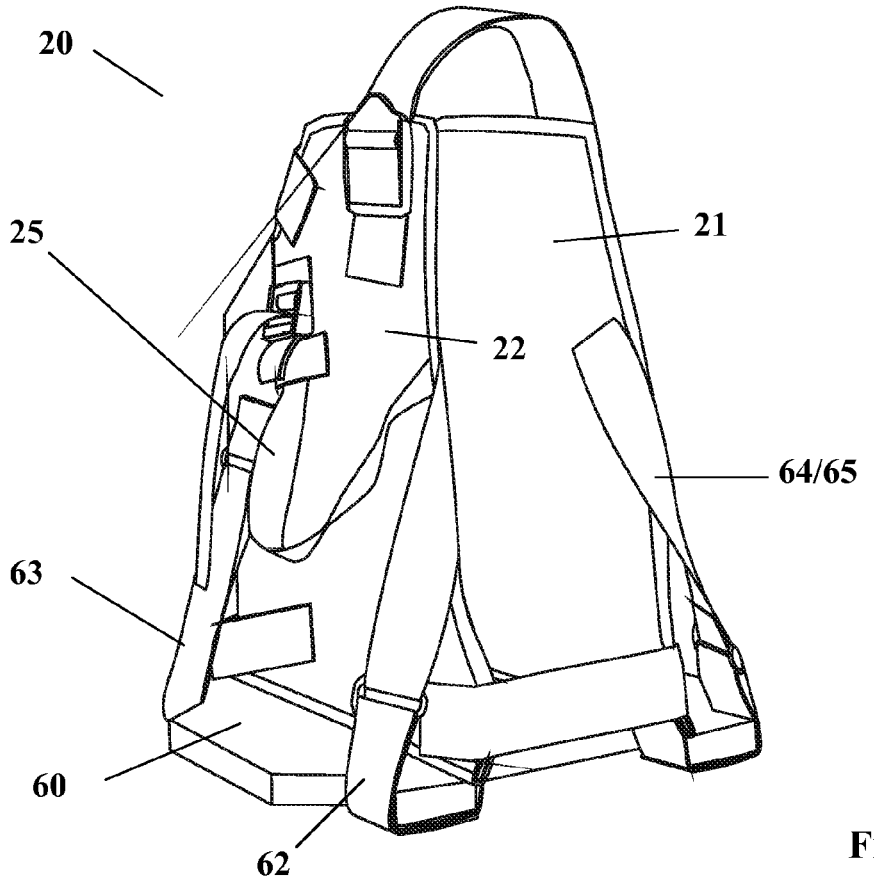
FIG. 8 is a perspective rear view of the invention.

FIG. 8 shows a base support 60 integrating with parallel structures 21 and 22. A preferred embodiment has parallel structures 21 and 22 constructed of fabric over rigid material with webbing material as straps 62, 63 64 and 65 (strap 65 not shown) connecting to base 60. While it is possible to secure weights to parallel structures alone, with strap 25 for example, a preferred embodiment has base 60 supporting at least a portion of load.

Figure 9:
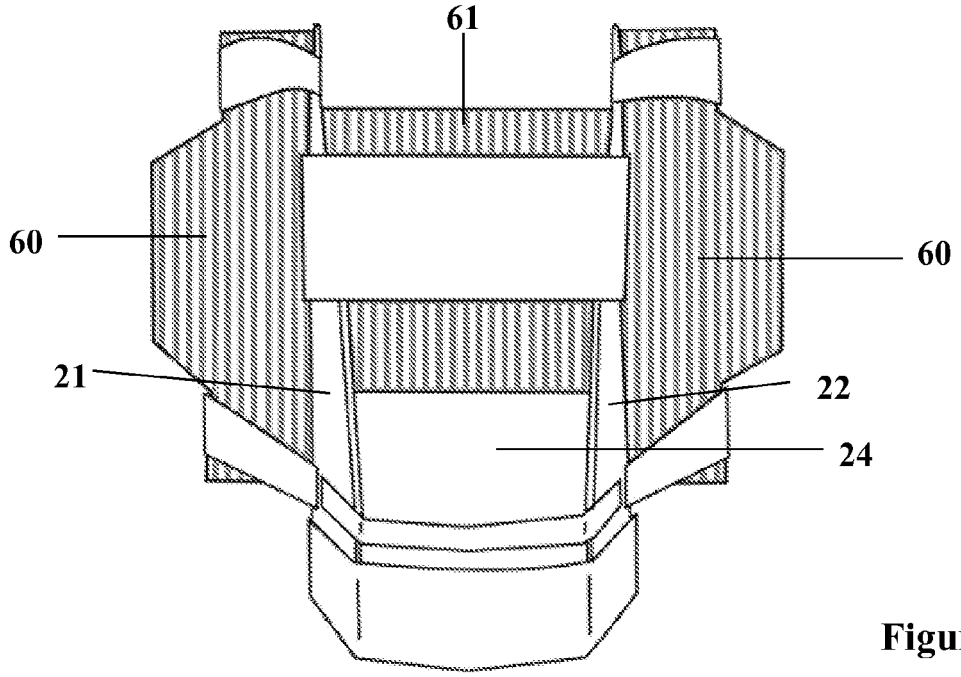
FIG. 9 is a plan view of the invention.
Figure 10:
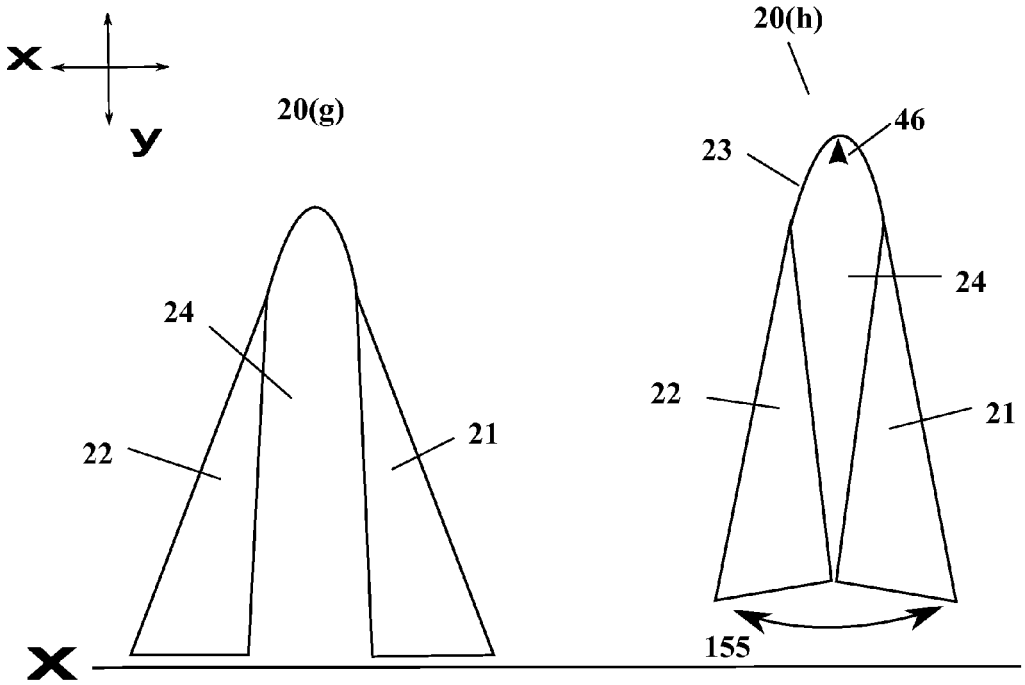
FIG. 10 is a front view of the invention depicting motion and gravity forces upon the invention when in use.

Plan view FIG. 9 shows base support 60 spanning the gap 24 between parallel structures 21 and 22. This construction further stabilizes the invention and minimizes pendulum motion between parallel structures 21 and 22 as illustrated in the front view of FIG. 10. The invention 20(*g*) is shown at rest and also in a lifted position 20(*h*) with active foot 46 acting as a pivot point against foot support 23. With fabric construction, or other flexible materials, parallel structures 21 and 22 will pendulum inward toward each other along an "x" axis as indicated by curved arrow 155. In plan view, "x" axis is a line that runs perpendicular to the length of an operator's body. Maintaining gap 24 between parallel structures 21 and 22, the invention is easier to control and more comfortable to use.

Figure 11:
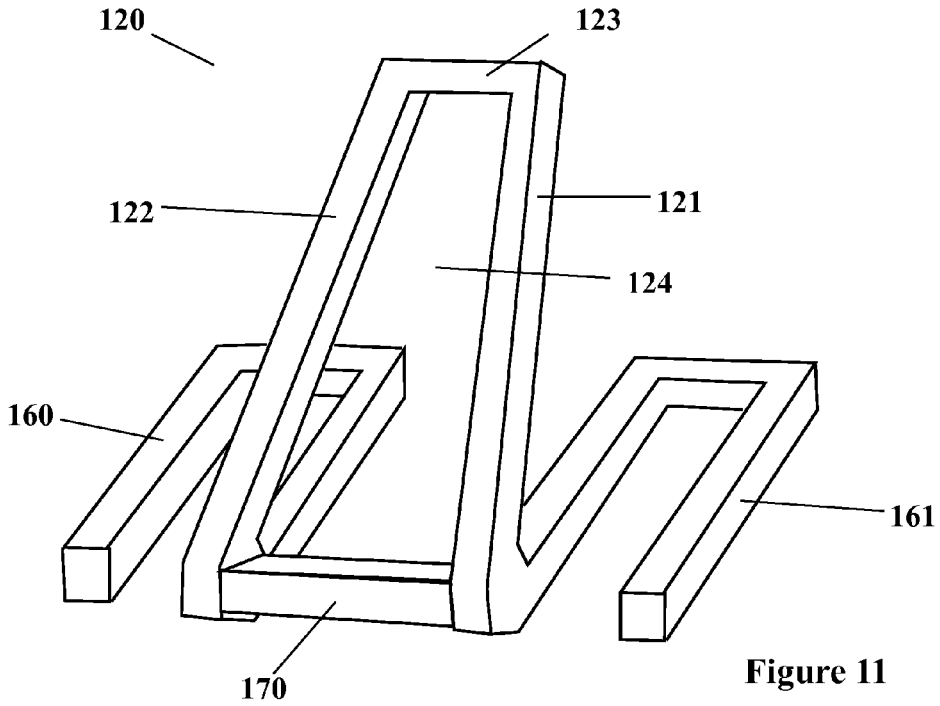
FIG. 11 is a perspective front view of a rigidly constructed alternative embodiment of the invention.

Alternative construction materials are possible. FIG. 11 shows a perspective view of an alternative embodiment of the invention 120 constructed of rigid materials. Welded or bent tube, for example, can be formed to accomplish the intention of the invention 120. Parallel structures 121 and 122 rise vertically to hold foot support 123 in an elevated position and have a gap 124. Base supports 160 and 161 can support at least a portion of load. Leg stabilizers, for example anterior leg stabilizer 170, can be added and stability can be accomplished first by the rigidity and strength of the material of construction and also by adding components that span the gap 124 to connect with parallel structures 121 and 122.

Figure 12:
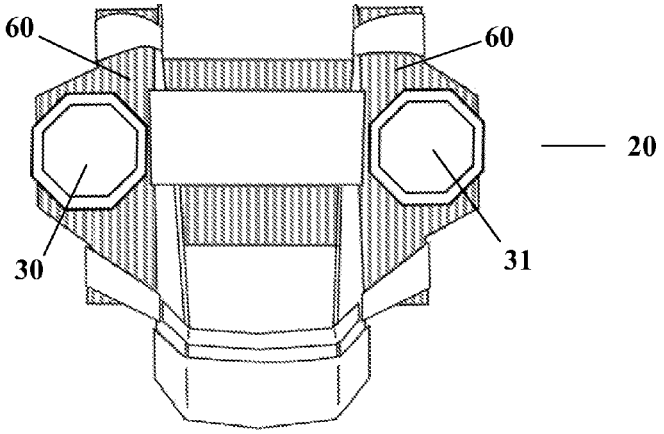
FIG. 12 is a plan view of an embodiment of the invention with weights secured in a vertical orientation.
Figure 13:
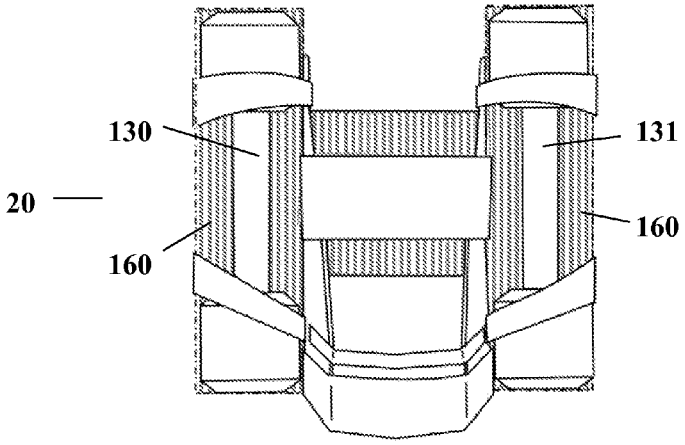
FIG. 13 is a plan view of an embodiment of the invention with weights secured in a horizontal orientation.

Weights can be used with the invention 20 in a number of ways. Several examples are demonstrated in plan view FIG. 12 where base 60 supports weight of dumbbell or dumbbell like construction, shown as dumbbells 30 and 31 positioned in a vertical orientation. Alternatively, in plan view FIG. 13 base 160 supports weight of dumbbell or dumbbell like construction, shown as dumbbells 130 and 131 in a horizontal orientation.

Figure 14:
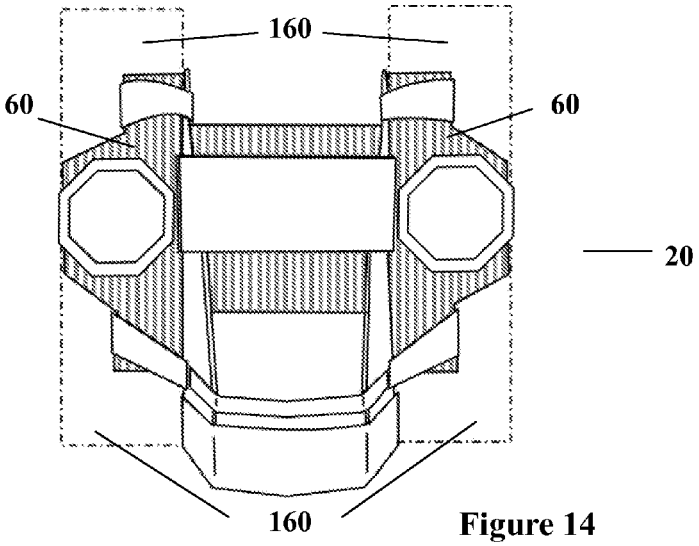
FIG. 14 is a plan view of the invention to show the contrast of an embodiment of the invention with weights secured in a vertical orientation to an embodiment of the invention with weights secured in a horizontal orientation.

FIG. 14 provides a plan view showing an overlay of base 60 designed for supporting weight of dumbbell or dumbbell like construction in a vertically oriented position over base 160 which is designed to support weight of dumbbell or dumbbell like construction in a horizontal orientation. Base 60 has sufficient area to support the lower head of a vertically oriented weight yet comprises less area than would otherwise be needed to secure weights in the horizontal orientation, and thereby having the advantage of minimizing incidental contact of base 60 with a passive leg or foot of an operator while performing exercises.

Figure 15:
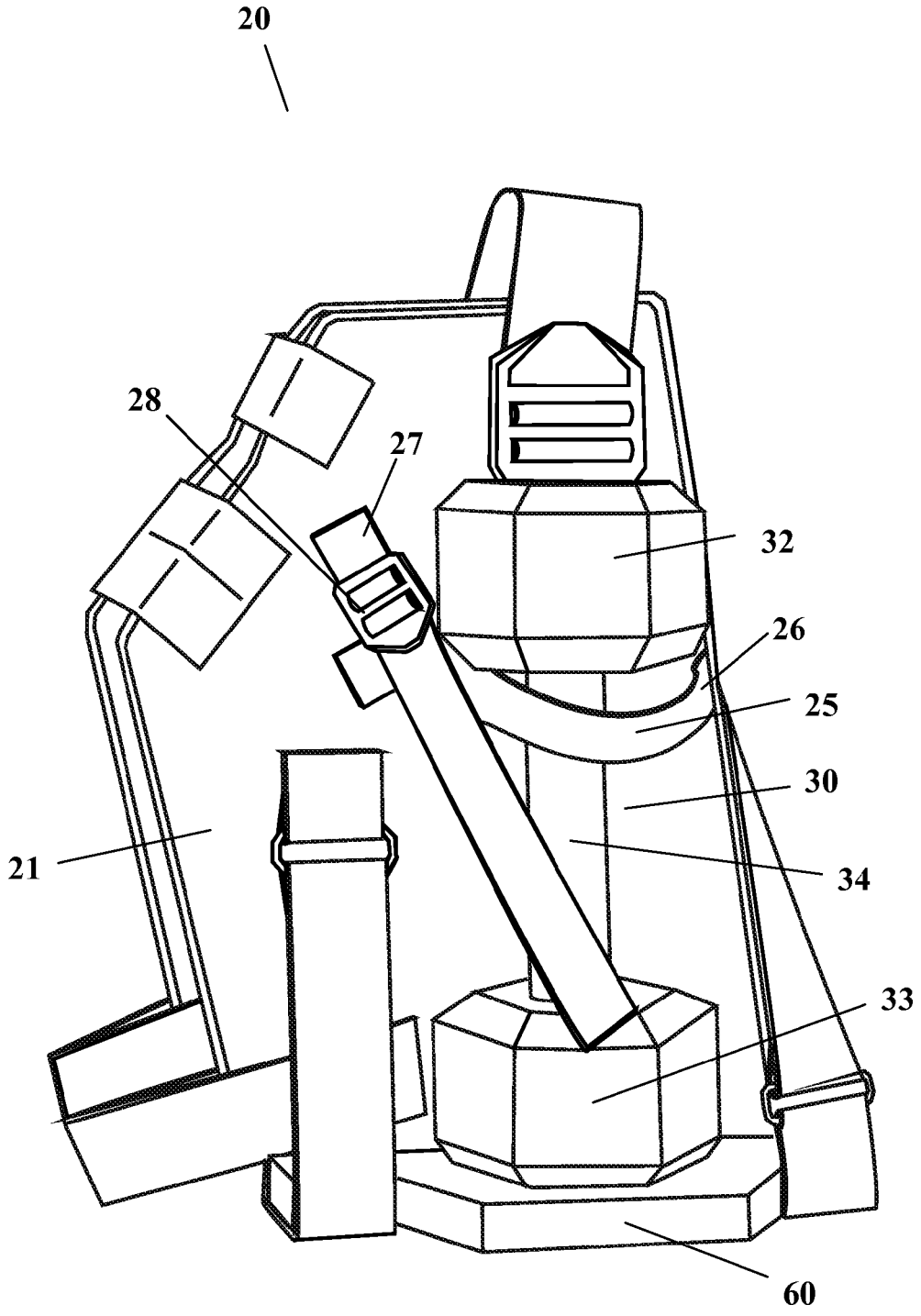
FIG. 15 is a side view of the invention.

The invention is intended to hold weights for the purpose of performing various lower body muscle group exercises. Work out weights come in many different shapes and sizes and custom shapes can be fabricated or cast. It is important to note that there is a cost advantage to using readily available workout weights with the invention. Dumbbells, for example, are readily available and can be used for other types of workouts other than what is suggested by the invention. Many households and fitness centers already have dumbbells. Although it is not the intention of this discussion to limit the invention to the use of dumbbells, the advantage of using dumbbells with the invention should be obvious to those skilled in the art FIG. 15 shows a side view of the invention to demonstrate the use of dumbbells as a preferred embodiment. A dumbbell 30 when standing on end vertically consists of an upper head 32, a lower head 33 and shaft 34 connecting both heads 32 and 33. Connecting or holding a dumbbell 30 aligned vertically to vertical surface 21 of an exercise device 20 can be accomplished simply and efficiently by supporting dumbbell 30 by the upper head 32. Strap 25 having a first end 26 and a second end 27. A simple arrangement has both first and second ends 26/27 connecting to a vertical surface 21. Strap 25 reaches across shaft 34 under the ledge of upper head 32 to suspend dumbbell 30. Strap 25 provides further stability by having an adjusting feature 28, for example, a buckle or cam lock to allow tightening and loosing of strap 25 about shaft 34.

Further stability can be achieved having a support base 60 upon which to rest lower head 33. Base 60 can have sufficient area to support the lower head 33 of a vertically oriented dumbbell 30 yet comprise less area than would otherwise be needed to secure weights in the horizontal orientation.

Figure 16:
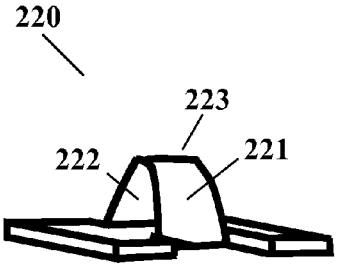
FIG. 16 is a perspective view of an embodiment of the invention.

FIG. 16 provides a front perspective view of the invention 220. This alternative embodiment can be used for leg extension exercises for the benefit of the vastus medialis muscle. Parallel structures 221 and 222 are positioned in a vertical orientation while foot support 223 has an elevated position.

Figure 16A:
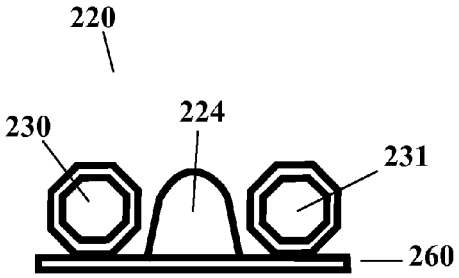
FIG. 16A is a front view of the same embodiment of the invention.

FIG. 16A is a front view of the invention 220 showing weights as dumbbells supported on base 260. Parallel structures 221 and 222 are positioned with adequate space 224 between to insert the active foot 246 (shown later in FIG. 17) of an operator.

Figure 16B:
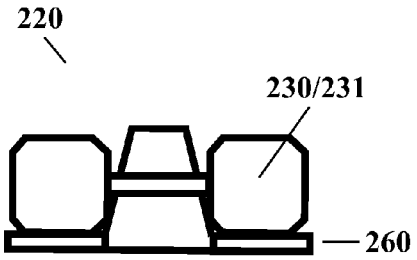
FIG. 16B is a side view of the same embodiment of the invention.

FIG. 16B is a side view of the invention 220 showing weights as dumbbells 230 and 231 positioned horizontally and supported on base 260.

Figure 17:
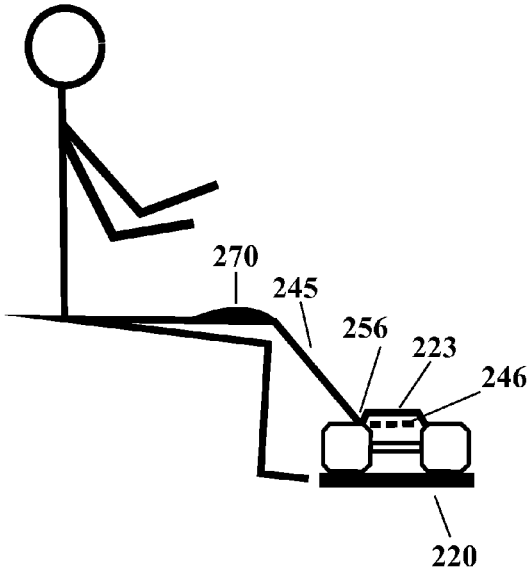
FIGS. 17 and 17A show a side view sequential animation of a preferred use of the same embodiment of the invention.

In FIG. 17, an operator, in a sitting position (chair or bench, for example, is not shown), engages foot support means 223 with the dorsal (upper) surface of an active foot 246 shown as dashed line 246, or the anterior ankle area 256, or a combination of both dorsal foot 246 and anterior ankle surface 256.

Figure 17A:
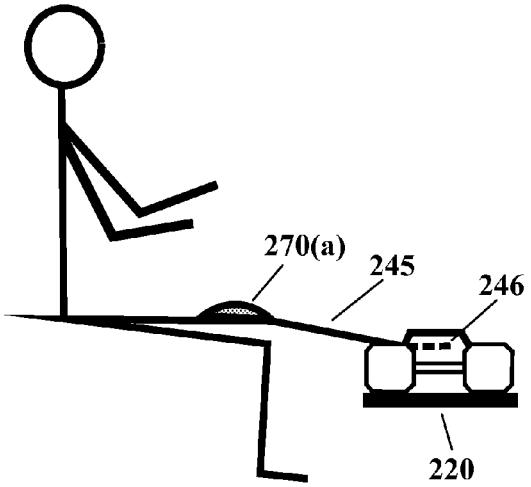

Further in FIG. 17A, an operator raises active leg 245 to elevate foot shown as dashed line 246, and the invention 220 to perform the leg extension exercise for the benefit of the vastus medialis muscle 270(*a*). Vastus medialis 271 (*a*) is shown enlarged to represent the contraction of the muscle as the leg extension exercise is performed.

Figure 18:
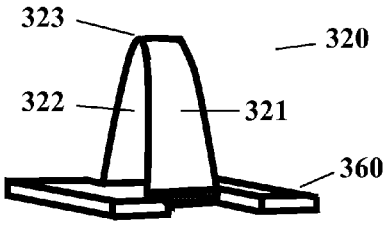
FIG. 18 is a front perspective view of an embodiment of the invention.

FIG. 18 provides a front perspective view of the invention 320. This alternative embodiment can be used for leg contraction (leg curl) exercises for the benefit of the posterior thigh muscle group (hamstring muscles) including, for example, biceps femoris, semitendinosus, and semimembranosus muscles. Parallel structures 321 and 322 are positioned in a vertical orientation while foot support 323 has an elevated position.

Figure 18A:
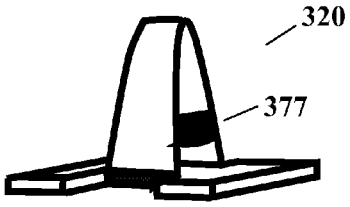
FIG. 18A is a rear perspective view of the same embodiment of the invention.

FIG. 18A is rear perspective view of the invention 320 and shows plantar foot stabilizer 377.

Figure 18B:
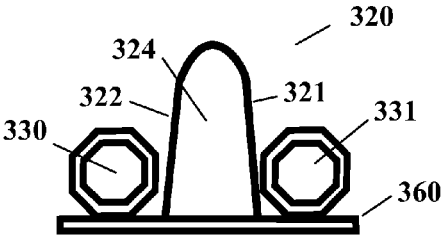
FIG. 18B is a front view of the same embodiment of the invention.

FIG. 18B is a front view of the invention 320 showing weights as dumbbells 330 and 331 supported on base 360. Parallel structures 321 and 322 are positioned with adequate space 324 between to insert the active foot 246 (shown later in FIG. 17) of an operator.

Figure 18C:
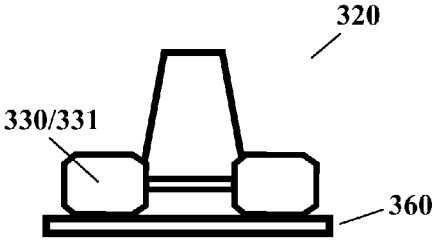
FIG. 18C is a side view of the same embodiment of the invention.

FIG. 18C is a side view of the invention 320 showing weights as dumbbells 330 and 331 positioned horizontally and supported on base 360.

Figure 19:
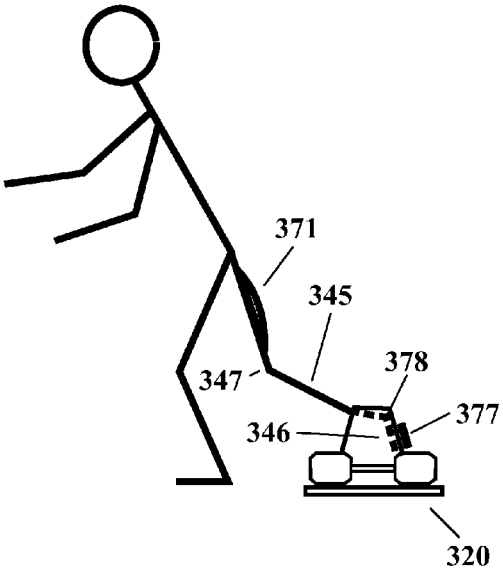
FIGS. 19 and 19A show a side view sequential animation of a preferred use of the same embodiment of the invention.

As shown in FIG. 19, an operator in a standing position can lean against a chair or a bench for example (not shown) or similar object that an operator can use for balance and to prop an active knee 347 against. The posterior side of the calcaneus area of the heel or the Achilles tendon area of the ankle 378 or a combination of both calcaneus area and Achilles tendon area engages foot support 323. Plantar foot stabilizer 377 allows an operator to engage at least a portion of the plantar (underside) surface of the active foot 346, thereby providing stability by minimizing swinging motion.

Figure 19A:
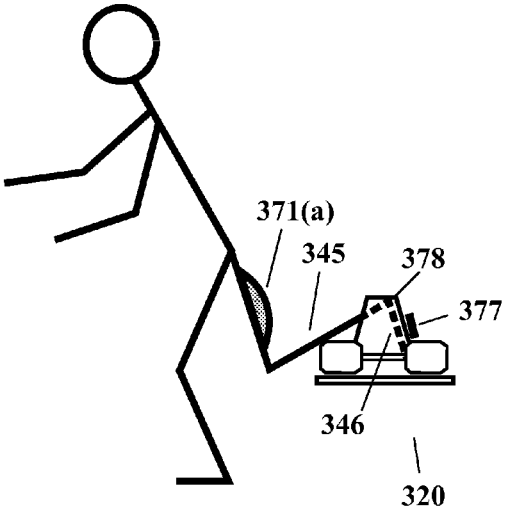

Further FIG. 19A, an operator raises active leg 345 to elevate foot, shown as dashed line 346, and the invention 320 to perform the leg contraction (leg curl) exercise for the benefit of the posterior thigh muscle group 371(*a*) (hamstring muscles) including, for example, biceps femoris, semitendinosus, and semimembranosus muscles. Posterior thigh muscle group 371(*a*) is shown enlarged to represent the contraction of the muscles as the leg contraction exercise is performed. Plantar foot stabilizer 377 can be adjustable for the comfort of the user. Hook and loop, often referred to as trademarked Velcro™ brand fabric, provides a simple adjustable means to attach and adjust the stabilizer.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A lower body exercise device suited for quadruped hip extension exercise for the benefit of the gluteus muscle group of a person having inserted a lower leg therein, the device comprising:

a generally flat, horizontal, rigid base;

a pair of planar side supports, each of said side supports extending upwardly from said base and having a front, rear and top, said side supports being generally parallel to each other with inward and outward facing surfaces, said inward facing surfaces spaced apart a sufficient distance to accommodate a lower leg of a person;

an anterior leg stabilizer strap extending between fronts of said side supports proximate to said base;

a posterior leg stabilizer strap extending between fronts of said side supports above said anterior leg stabilizer strap;

a foot support strap extending between tops of said side supports; and each of said side supports having at least one strap for securing a dumbbell in a generally vertical orientation.

2. An exercise device as in claim 1, wherein said device has a pair of dumbbells secured thereto, each of said dumbbells being secured to said outward facing surface of each of said side supports by at least one strap.

3. An exercise device as in claim 2 wherein when said pair of dumbbells is attached, a center of gravity of said device is located vertically below said foot support strap.

4. An exercise device as in claim 1, wherein each of said anterior leg stabilizer strap, said posterior leg stabilizer strap, and said foot support strap has an adjustable length.

5. An exercise device as in claim 1, wherein said anterior leg stabilizer strap is positioned to be in contact with an anterior surface of a lower leg inserted between said side supports.

6. An exercise device as in claim 5, wherein said posterior leg stabilizer strap is positioned to be in contact with a posterior surface of a lower leg inserted between said side supports.

7. An exercise device as in claim 6, wherein said device has a second posterior leg stabilizer strap extending between fronts of said side supports above said anterior leg stabilizer strap and positioned to be in contact with a posterior surface of a lower leg inserted between said side supports.

* * * * *